US009592434B2

(12) United States Patent
Slagter

(10) Patent No.: US 9,592,434 B2
(45) Date of Patent: Mar. 14, 2017

(54) STAND-ON LAND VEHICLE FOR SIMULATING SKIING

(71) Applicant: Mark A. Slagter, Palos Verdes Estates, CA (US)

(72) Inventor: Mark A. Slagter, Palos Verdes Estates, CA (US)

( * ) Notice: Subject to any disclaimer, the term of this patent is extended or adjusted under 35 U.S.C. 154(b) by 0 days.

(21) Appl. No.: 14/683,702

(22) Filed: Apr. 10, 2015

(65) Prior Publication Data

US 2017/0007900 A1 Jan. 12, 2017

(51) Int. Cl.
*A63B 69/18* (2006.01)

(52) U.S. Cl.
CPC ..... *A63B 69/18* (2013.01)

(58) Field of Classification Search
CPC ..... A63C 5/035; A63C 17/045; A63B 69/18; A63B 69/182
USPC ..... 280/842
See application file for complete search history.

(56) References Cited

U.S. PATENT DOCUMENTS 2,248,214 A * 7/1941 Bleecker ..... A63H 11/10 280/842
2,545,543 A * 3/1951 Bottrill ..... A63C 5/035 280/11.204
2,819,907 A * 1/1958 Thoresen ..... A63C 5/035 280/606
3,171,667 A * 3/1965 Wightman ..... A63C 5/16 280/818
3,436,088 A * 4/1969 Kunselman ..... A63C 5/035 280/14.21
3,545,779 A * 12/1970 Simms ..... A63C 5/035 280/11.28
3,684,305 A * 8/1972 McDonald ..... A63C 17/004 280/11.19
3,827,706 A * 8/1974 Milliman ..... A63C 5/035 280/842
3,856,321 A * 12/1974 Solymosi ..... A63C 17/0033 280/842
3,862,764 A * 1/1975 Hartz ..... A63C 5/16 280/818
3,907,320 A * 9/1975 Charneck ..... A63C 5/16 280/818
4,133,546 A * 1/1979 Rosenblum ..... A63C 5/035 280/842
4,134,600 A * 1/1979 McDonald ..... A63C 5/035 280/11.28

(Continued)

FOREIGN PATENT DOCUMENTS

WO WO2012038554 A1 * 3/2012

*Primary Examiner* — Hau Phan
*Assistant Examiner* — Jacob Meyer
(74) *Attorney, Agent, or Firm* — J. E. McTaggart

(57) ABSTRACT

A side-by-side pair of platforms, each equipped with a foot-pad, are coupled in a manner to form a vehicle, and are supported (a) at the rear by a truck-mount under each platform, integrated with a shared axle assembly fitted at its ends with a pair of rear wheels, located at opposite sides of the vehicle, and (b) at the front by a tilt-turn mount system including at least one front wheel, typically a caster-mounted roller, accomplishing dual-platform tilt-turning in response to the user's body movements simulating superior snow-skiing techniques, thus enabling sustained self-propulsion by user body movements and providing recreation, training and practice for skiers of all ages and skill levels.

13 Claims, 7 Drawing Sheets

(56) References Cited

U.S. PATENT DOCUMENTS 4,353,566 A * 10/1982 Mohlenbrock ..... A63C 17/01 280/11.28
4,460,187 A * 7/1984 Shimizu ..... A63C 5/035 280/11.208
4,738,456 A 4/1988 Creason
4,805,936 A * 2/1989 Krantz ..... A63C 17/1409 152/8
4,886,298 A * 12/1989 Shols ..... A63C 11/24 280/842
5,372,384 A * 12/1994 Smith ..... A63C 11/00 280/11.28
7,762,564 B2 7/2010 Stene-Johanson et al.
7,784,833 B2 * 8/2010 Tsuchie ..... A63C 17/004 280/11.19
8,181,975 B2 * 5/2012 Parhar ..... B62K 3/002 280/209
8,360,475 B2 * 1/2013 Cristiano ..... A63C 17/004 280/11.19
8,585,562 B2 * 11/2013 Chen ..... A63B 21/025 482/111
8,636,288 B2 * 1/2014 Jeon ..... A63C 17/012 280/11.221
8,870,193 B2 * 10/2014 Kowalski ..... A63C 5/035 280/11.223
8,888,108 B1 11/2014 Beaty et al.
2009/0045598 A1 * 2/2009 Lee ..... A63C 17/0033 280/87.042
2011/0298194 A1 * 12/2011 Sanchez ..... A63C 17/045 280/245
2012/0126523 A1 * 5/2012 Langer ..... A63C 17/045 280/842
2015/0042083 A1 2/2015 Parent et al.
2015/0061252 A1 3/2015 Lininger, Jr.
2016/0144257 A1 * 5/2016 Bradford, III ..... A63B 69/18 434/253
2016/0175692 A1 * 6/2016 Burns ..... A63C 17/045 280/842

* cited by examiner

STAND-ON LAND VEHICLE FOR SIMULATING SKIING

PRIORITY

Benefit is claimed under 35 U.S.C. 119(e) of provisional patent application 61/982,274 filed Apr. 21, 2014.

FIELD OF THE INVENTION

The present invention relates to the field of personal stand-on land vehicles, and more particularly, those with wheeled foot-platforms intended to simulate snow-skiing in order to enable all-year dry-land practice, training and instruction relating to recreational, competitive and professional snow skiing.

BACKGROUND OF THE INVENTION

Skis and ice skates have long remained a preferred choice for unpowered personal stand-on vehicles for recreation and competitive events, when and wherever available, subject to climatic and seasonal limitations. These vary in north America and globally, ranging from far-away relatively unpopulated polar regions where skis and ice skates, along with snowshoes, become routinely essential for personal mobility, to populated tropical regions where natural ice and snow are unknown and where skating/hockey rinks and ski resorts are few and far between.

For many located between these extremes, the pleasure of skiing is a luxury to be enjoyed if and whenever available, typically within the time slot of a short season, even if it involves the time and expense to travel to a ski resort. Professional and competitive skiing continue to enjoy progress and popularity, however, many skiers, frustrated by the severe limitations on time and availability to practice skiing, would welcome a viable way of keeping in condition during the long off-season, this unfulfilled need is addressed by the present invention.

Understanding the key points of novelty of the invention, which are subtle, mechanically complex and not immediately obvious or intuitive, requires detailed focus on particular aspects of state-of-the art skiing, unpowered stand-on land vehicles including wheels, wheel mounts and bearings, and known art skiing simulators, relating to the present invention.

Skiing: The invention relates particularly to downhill skiing, ranging from (a) gliding slowly down a shallow slope in a linear travel path requiring only minimal skill level, i.e. little, if any steering (apart from emergencies such as confronting a tree or rock), and only ordinary balance, as in standing and walking, to (b) zig-zagging rapidly down a steep slope, involving frequent maximally-sharp turns, e.g. in its extreme form, slalom competition, which demands the maximum available human skill levels, including muscular body movements co-ordinated for ongoing rapid abrupt changes in balance, momentum, force translations, etc. Instruction, training and practice of skiing, and simulation relating to the present invention pertain primarily to skills and techniques of steering, ranging from incremental changes of heading to sharp cornering.

At the highest skill levels in state-of-the-art downhill skiing mechanics and techniques, when making a "right hand parallel turn", the skier gradually rolls and tilts his skis over to the right, "banking" the skis and the skier for the turn, in the manner of "banking" curved railroad tracks and train vehicles; simultaneously the skier gradually "skews" the skis from toe-to-toe rectangularity by moving the inside (right hand) ski forward in relation to the outside (left hand) ski. The skis in turn gradually bend into an increasingly closed arc and the metal edges of the skis begin to "carve" a "right hand turn". To complete the turn the skier gradually untilts the skis back to level while gradually moving the inside ski back until it arrives at a "neutral" position with the skis again rectangular (toe-to-toe) and flat on the snow, ready to travel on in a linear path or begin another turn, which if "left hand" requires similar but symmetrically opposite movements.

Unpowered stand-on land vehicles of interest regarding the present invention, as candidates for skiing simulation (having become associated with the youthful portion of the population due to the automobile) have evolved from once-popular rollerskates and scooters, as minor would-be rivals of skis, skates and snowboards, to the present predominance of skateboards, accompanied by a high degree of skill achievement of skateboarders and related enhancement of skateboards due to research and development. In the evolution of rollerskates, 2-wheeled attempts to simulate ice skates yielded to 4-wheelers for safety and ankle comfort, strapped or clipped onto, or made integral with the shoes.

Wheel mounts for attaching the front and rear rollerskate wheel pairs to the shoes evolved from firmly affixed to some degree of flexibility for tilting to facilitate and enhance turning, leading to the widespread use, in the present day skateboard predominance, of highly developed wheel "mounts" or "trucks" that couple a skateboard to the axle of a wheel-pair via an angled swivel arrangement that enables the user to steer by tilting the skateboard laterally for making turns, much in the manner of making turns in skiing as described above, wherein each ski is "banked", i.e. tilted by the skier to "carve" a turn. However, the all-important "skewing" technique described above for skiing turns cannot be simulated by a single foot-platform such as a skateboard, or by a pair of foot-platforms affixed together or uncoordinated.

Low-friction bearings developed for wheels and rollers of rollerskates and skateboards facilitate and enhance free-wheel coasting and sustained zig-zag self-propulsion on a level surface, unattainable in snow-skiing due to the higher effective friction involved in turns, even with skilled turn "carving" as described above.

DISCUSSION OF KNOWN ART

U.S. Pat. No. 3,684,305 issued Aug. 15, 1972 to McDonald et al for ROLLER SKI APPARATUS discloses a rollerskate-like assembly with tilt-steer mounts at front and rear wheel pairs of a "foot platform . . . provided with a control handle attached to its side margin . . . such as to facilitate banking control", shown deployed singly with a user's both feet on one platform, and also shown deployed in an independent pair with the user's feet attached one onto each foot platform and the control handles held one in each of the user's hands.

U.S. Pat. No. 4,805,936 issued Feb. 21, 1989 to Krantz for a WHEELED SKI discloses attached ski-boots, deformable wheels and "handheld braking mechanism for controlling speed and direction of travel".

U.S. Pat. No. 7,784,833 B2 issued Aug. 31, 2010 to Tauchie for ROLLER SKIS discloses a "board made of an elastic material", "a boot secured to the board", non-angled "top and tail casters", plus "four fixed rollers disposed in parallel on a central lower face" of the board.

U.S. Pat. No. 5,372,384 issued Dec. 13, 1994 to Smith for a SKI-TURN SIMULATOR discloses and shows a pair of short platforms extending outboard from opposite sides of a central elongate wheeled main board as "simulated skis" whereby "both edging of the simulated skis and preferential weighting of the outside simulated ski contribute to tightening of the turn to prevent a fall by the user".

U.S. Pat. No. 7,762,564 B2 issued Jul. 27, 2010 to Stene Johanson et al for a SKI SKEDGE discloses a ski sledge having a swiveling front ski with steering means, two essentially parallel rear skis and a seat connected via on or more rods to the steering means, where the rear skis are connected to the sledge by means of a parallelogram arrangement.

U.S. application 20020195788 published Dec. 26, 2002 for a STEERABLE IN-LINE STREET SKI discloses "a street ski comprising an elongated platform, a pair of trucks and a pair of wheels. Each truck includes a wheel support pivotably associated with the elongated platform and a spring connected to the wheel support for resisting pivoting of the wheel support relative to the elongated platform.

None of the above disclosures or other known publication teach, show, or suggest the novel principles and integrated dual-truck rear axle assembly co-operating with a front end spacing framework as dual variable-angle parallelograms, enabling the present invention of a stand-on land vehicle for simulating snow-skiing particularly directed to mechanically simulating advanced "ski-skewing" technique for turning and authenticated by actual performance that not only proves to be effective for training and practice of snow-skiing, but opens up new recreational aspects related to skateboarding as demonstrated by capability of self-propulsion on a level surface.

OBJECTS OF THE INVENTION

It is a primary object of the present invention to provide a one-user stand-on land vehicle that can be operated on a flat solid land-based surface in a manner that simulates key aspects of downhill snow-skiing including tilting and skewing, as described above, for purposes of recreation, practice and training relating to snow-skiing, made and arranged to be beneficial to snow skiers of all ages and skill levels.

It is a further object to provide the vehicle with (a) with two foot-platforms mechanically linked to each other in a manner to remain spaced apart uniformly side-by-side, substantially parallel and held level for linear travel, (b) at least three roller-wheels, attached at the underside of the vehicle, interfacing an underlying environmental travel surface, and (c) a steering system responsive to the user tilting the foot-platforms laterally from level.

It is a still further object for the linkage between the foot-platforms to be made and arranged to interact with the steering system in a manner that, for turning by tilt-steering, relocates the foot-platforms (from uniformly side-by-side for linear travel) to skew them longitudinally so that the one nearer to the direction of the turn is advanced to lead the other by a designated amount that is proportional to the sharpness of the turn, in accordance with turning technique of expert snow skiers.

It is an overall objective to teach structure of the vehicle that can accomplish sustained self-propulsion on level pavement or concrete by driving force generated from body movements during turns of a zig-zag travel path, closely simulating body movements associated therewith in downhill snow-skiing.

SUMMARY OF THE INVENTION

The above described objects have been met in the present invention of a stand-on land vehicle, for simulating snow-skiing with emphasis on ski-skew turning technique, wherein a side-by-side pair of platforms are coupled and supported (a) at the rear by an integrated dual-truck axle assembly fitted at its ends with a pair of rear wheels located at opposite sides of the vehicle, supporting a rear portion of the vehicle via an angled-swivel tilt-steer mount under each platform and (b) at the front by an angled-swivel tilt-turn system including an angled extension strut/spacer framework attached to a pair of user handling bars, and to at least one front wheel, typically a roller in an angled-swivel-caster type mount. This novel combination accomplishes dual-platform tilt-turning and skewing in response to the user's body movements that simulate the superior snow-skiing technique of "ski-skewing" the "inside" ski longitudinally for banked turns as in zig-zagging downhill. The invention actually enables sustained self-propulsion, zig-zagging on level concrete and paved surfaces, powered only by user body movements during turns and enhanced by low-friction roller-wheels for free-wheeling coasting on straight runs, and is thus capable of providing, on dry land, both recreational pleasure and highly effective training and practice for snow-skiing for snow skiers of all ages and skill levels.

NOTE: Regarding the terms "wheel" and "roller", which are often used interchangeably, the McGraw-Hill Dictionary of Scientific Terms (fifth edition) a wheel is defined as "a circular frame with a hub at the center for attachment to an axle about which it may revolve and bear a load", and a roller is defined as "a cylindrical device for transmitting motion and force by rotation". In view of the substantial overlap in these definitions, particularly in regard to the present invention, and widespread use of the terms interchangeably, for purposes of this disclosure "wheel" is to be taken as the generic term, and "roller" denoting a particular sub-category: i.e. a type of wheel characterized by a substantial amount of "tread-width" i.e. peripheral surface (end-to-end of a roller) interfacing the underlying travel surface, typically exceeding the wheel diameter. In the primary 3-wheeled embodiment of the present invention, the single front mount being a swivel caster type that, for stable operation, requires the front wheel to be a roller with sufficient "tread width", located to lag behind the angled pivot far enough to prevent wobbling. Such stabilization is not required for the rear wheels: they are inherently stable because, being at opposite ends of axle assembly 18, the pair of wheels function as opposite ends of a single large roller, reacting on the axle-affixed tilt-steer mounts in a manner that provides the required stability inherently, independent of the tread-width of each wheel. However, since wheels with narrow or rounded treads fail prematurely due to wear-off in normal usage, therefore, amongst wider options available in the design choice for rear wheels, rollers are preferred and shown herein, with the additional aesthetic advantage of matching the appearance of the front roller(s). Regarding wheel diameters, in the present embodiments wheels of a pair are normally made identical, whereas front wheels may differ from rear wheels as a matter of design choice.

BRIEF DESCRIPTION OF THE DRAWINGS

The above and further objects, features and advantages of the present invention will be more fully understood from the following description taken with the accompanying drawings in which:

FIG. 11 FIG. 3 is a side elevation view of the vehicle of FIG. 10'

DETAILED DESCRIPTION

Figure 1:
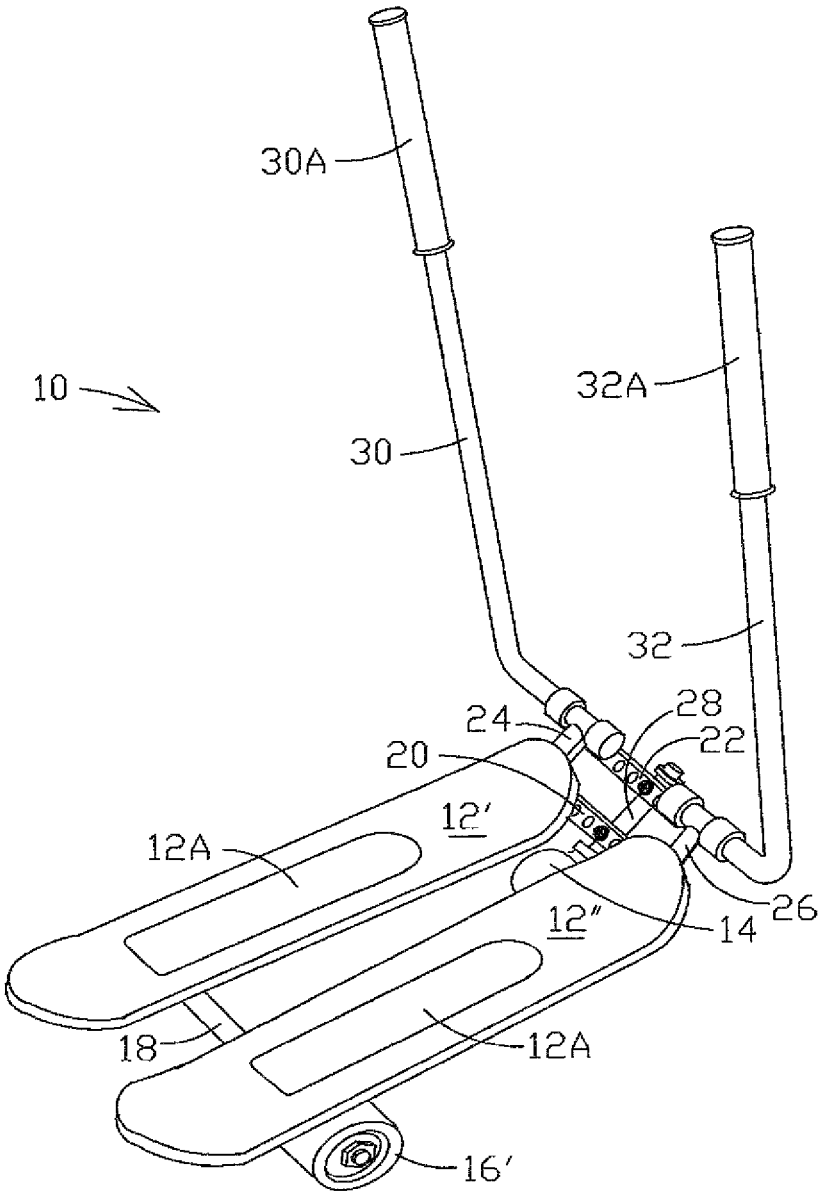
FIG. 1 is a three-dimensional view of a 3-wheeled stand-on land vehicle in a primary embodiment of the present invention.

In FIG. 1, a three-wheeled land vehicle 10 is a primary embodiment of the present invention having a pair of platforms 12' and 12", typically non-metallic "foot-boards", each with an attached non-slip foot-pad 12A, for purposes of easy escape for safety in lieu of attached ski-boots or harnesses. Vehicle 10 rides on a centrally located front roller 14 and a pair of rear wheels 16' (optionally rollers) at the ends of an axle assembly 18. At the front end, platforms 12' and 12 are (a) rigidly extended forwardly by metal extension struts 24 and 26, bent to incline upwardly, typically at 45 degrees, and (b) coupled at a designated side-by-side spacing by cross-spacers 20 and 22. A tubular pivot-bearing journal 28, attached centrally to cross-spacers 20 and 22 in their inclined plane (~45 deg.) is a thusly inclined swivel bearing portion of an angled swivel caster structure that includes front roller 14 installed between a pair of side brackets (see FIGS. 2-4) and serves as the vehicle's front-end angled-pivot tilt-steer mount.

A pair of handling bars 30 and 32, fitted with hand grips 30A and 32A, are secured to the forward ends of the inclined extension struts 24 and 26 to move in unison in a manner that allows free hinged movement in any fore-and-aft plane with no consequences, whereas lateral movement+/−from neutral center applies+/−tilt to the foot-platforms 12' and 12, working in conjunction with the user's foot pressures keep the wheels 14 and 16 aimed as desired for steering. Thus the handling bars 30 and 32, in place of ski-poles but somewhat different in function, serve to facilitate steering and user balance, as detailed below in connection with FIGS. 5-9, as well as enhancing safety and comfort.

At the rear, platforms 12' and 12" are held spaced apart, as shown, via a corresponding pair of special angled-swivel tilt-steer truck mounts, each with a lower portion integrated as part of axle assembly 18, enabling the user to steer by simultaneously tilting the platforms in either lateral direction, clockwise or counterclockwise from neutral level, held by linkage to tilt in unison, in the manner that simulates a good snow-skier's balanced foot control, typically exerted by both feet in unison, e.g. in tilting for turns. The polarity of platform tilt relative to turn direction is universally standard for making "banked" turns in vehicles of all kinds, including aircraft, watercraft, railroad trains, racecars, motorcycles, bicycles, etc., as well as in foot-controlled stand-on vehicles such as skateboards, ice skates, roller-skates and skis, as described hereafter in connection with FIG. 15, etc.

Figure 2:
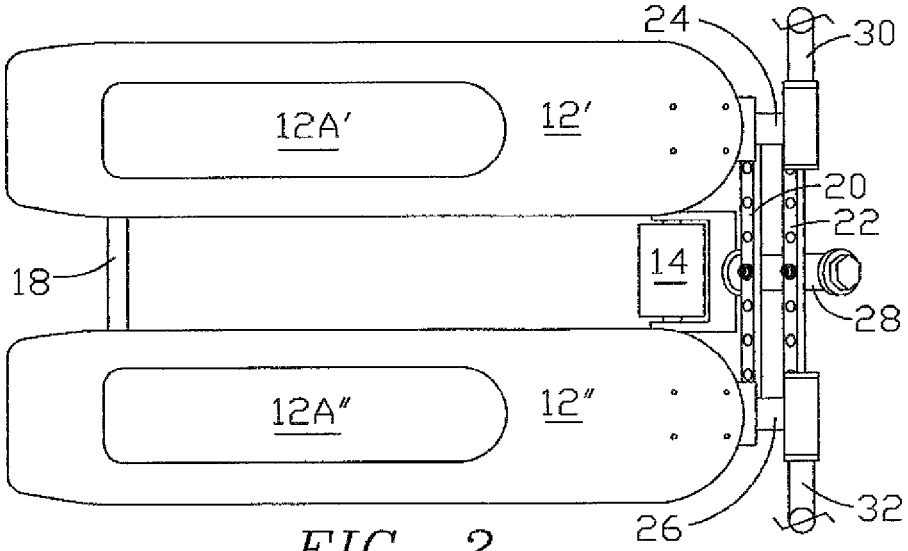
FIG. 2 is a top view of the vehicle of FIG. 1.
Figure 3:
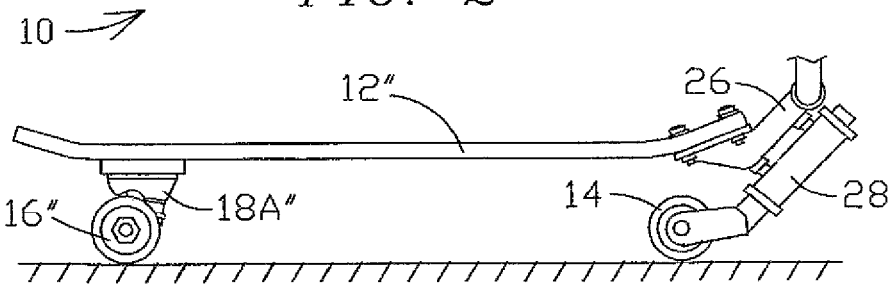
FIG. 3 is a side elevation view of the vehicle of FIGS. 1 and 2.
Figure 4:
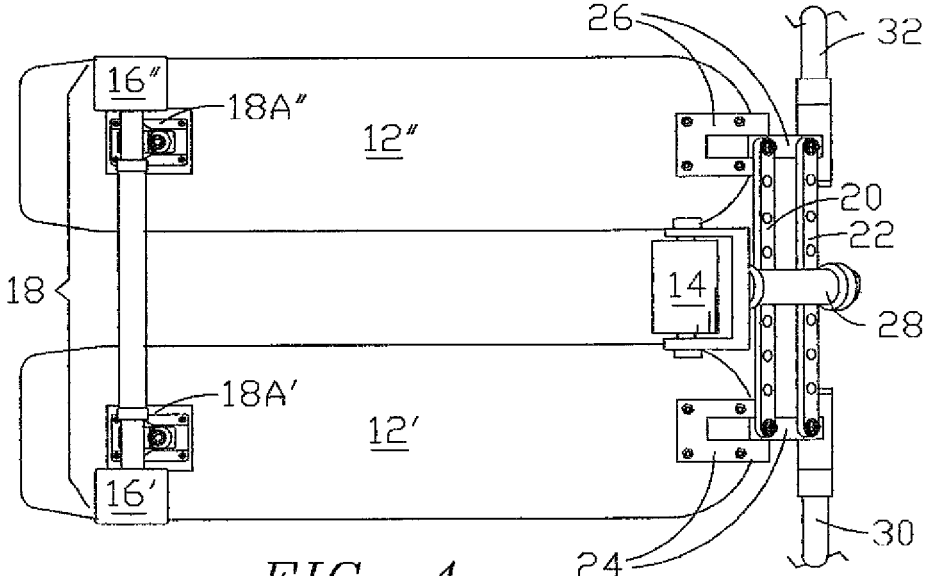
FIG. 4 is a bottom view of the vehicle of FIGS. 1-3.

FIGS. 2-4 show top, side and bottom views of the vehicle of FIG. 1 with the handling bars 30 and 32 cutaway, showing, in more detail, extension struts 24 and 26, front roller 14 and its caster-type angled-swivel tilt-steer mount, attached to spacers 20 and 22 by its pivot-bearing journal 28.

FIG. 3 shows side views of extension strut 26, of pivot journal 28 and roller 14 of the caster-type angled-swivel front tilt-steer mounting system, and of the upper portion of the right hand rear truck mount 18A", visible in this view above the right hand rear wheel 16A".

Figure 15:
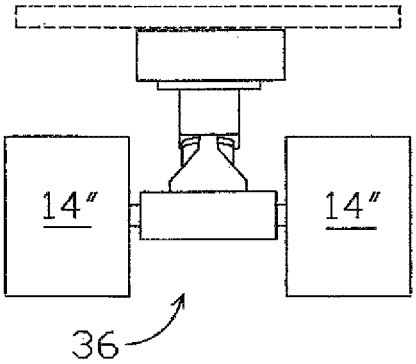
FIG. 15 PRIOR ART
FIG. 15 is an enlargement depicting a known skateboard truck 36 fitted with a pair of roller wheels and attached under a platform indicated by broken lines.

FIG. 4 shows platform-attachment plate details of extension struts 24 and 26, and shows the rear wheels 16' an 16" at the ends of axle assembly 18, and, adjacent to wheels 16' and 16", the rear tilt-steer truck mounts 18A' and 18A" whose upper and lower portions are coupled by an angled-swivel mechanism of a type used widely in skateboard trucks as described hereafter in connection with FIG. 15. The upper portions are attached to the underside of platforms 12' and 12" and the lower portions are integrated as part of the axle assembly 18, separated by an intermediate axle portion that establishes a designated separation dimension between the platforms 12' and 12".

FIGS. 5-9 illustrate mechanical details of tilt-turn operation of a 3-wheeled vehicle as in FIGS. 1-4, including capability of simulating the advanced technique of "ski-skewing" for turning by skewing the platforms longitudinally (from uniformly side-by-side toe-to-toe for linear travel) such that the one nearer to the direction of the turn is advanced to lead the other by a designated amount that is proportional to the sharpness of the turn, in accordance with turning technique of expert snow skiers as described above.

Figure 5:
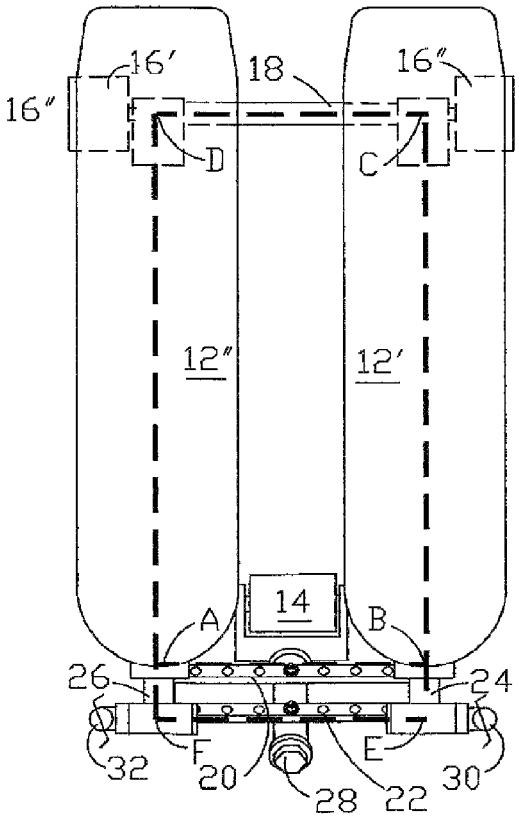
FIG. 5 is a top view as in FIG. 2, showing a rectangular pattern with the steering system set to hold the wheels set on-axis for linear travel.

In FIG. 5, a top view of the 3-wheeled primary vehicle embodiment, shown, as in FIG. 2, held in the neutral steering condition, showing movable items in the steering system indicated by reference points: A and B at the ends of spacer 20, approximating center front points of the platforms 12' and 12", points C and D, centered on each platform 12' and 12" above the axle assembly 18, forming a first parallelogram ABCD, A second parallelogram ABEF is formed by points E and F at the ends of spacer 22 and side AB at ends of spacer 20, shared with the thusly adjoined larger first parallelogram ABCD.

Figure 6:
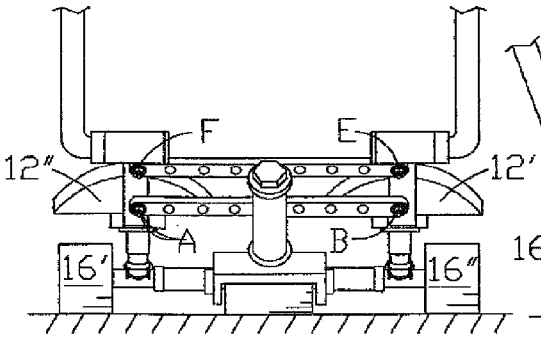
FIG. 6 is a front view of the vehicle in FIG. 5 showing the foot platforms level and the wheels set for linear travel.

FIG. 6, a front view of the vehicle of FIG. 5 shows the second parallelogram ABEF as viewed from the front, showing the platforms 12' and 12" held level laterally by the user for the neutral steering condition, and thus the rear wheels 16' and 16" and front roller 14 are held aimed at zero azimuth angle for linear travel.

For steering purposes, all corner fastenings of the structure in this two-parallelogram pattern are made slidably hinged in a manner to allow relative rotation of movable components, thus varying the angles simultaneously in parallelograms ABCD in a horizontal plane and ABEF in the (~45 degree) angled plane of the inclined portion of the front extension struts 24 and 26 (FIG. 1). The steering system is designed to hold both parallelograms orthogonal, i.e. as rectangles, with platforms 12' and 12" held uniformly side-by-side (unskewed) as shown in FIG. 5 and all wheels aimed at zero azimuth, as shown, for linear travel, whenever the user maintains the neutral steering condition by holding the platforms 12' and 12" level laterally as shown in FIG. 6.

Figure 7:
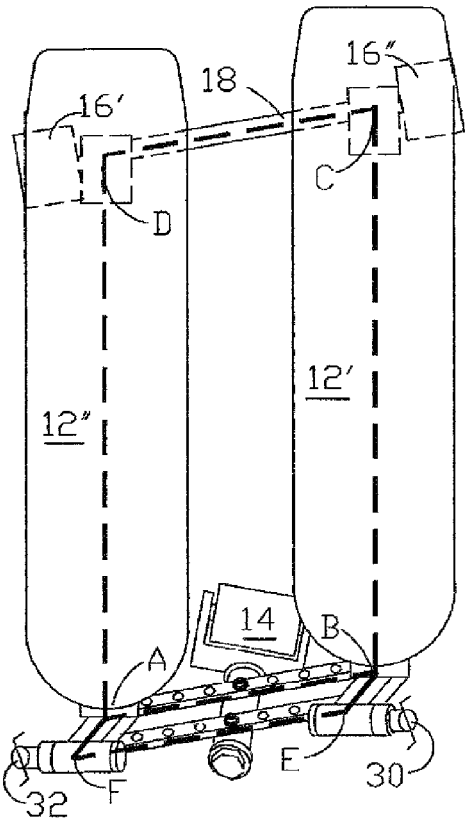
FIG. 7 is a top view as in FIG. 6 but showing a skewed parallelogram pattern with the steering system set to turn the vehicle in the direction indicated by the roller-wheels.
Figure 8:
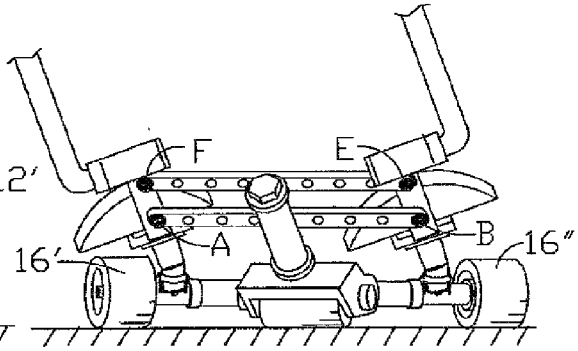
FIG. 8 is a front view of the vehicle as in FIG. 7 showing the foot platforms tilted and the wheels set for for turning.
Figure 9:
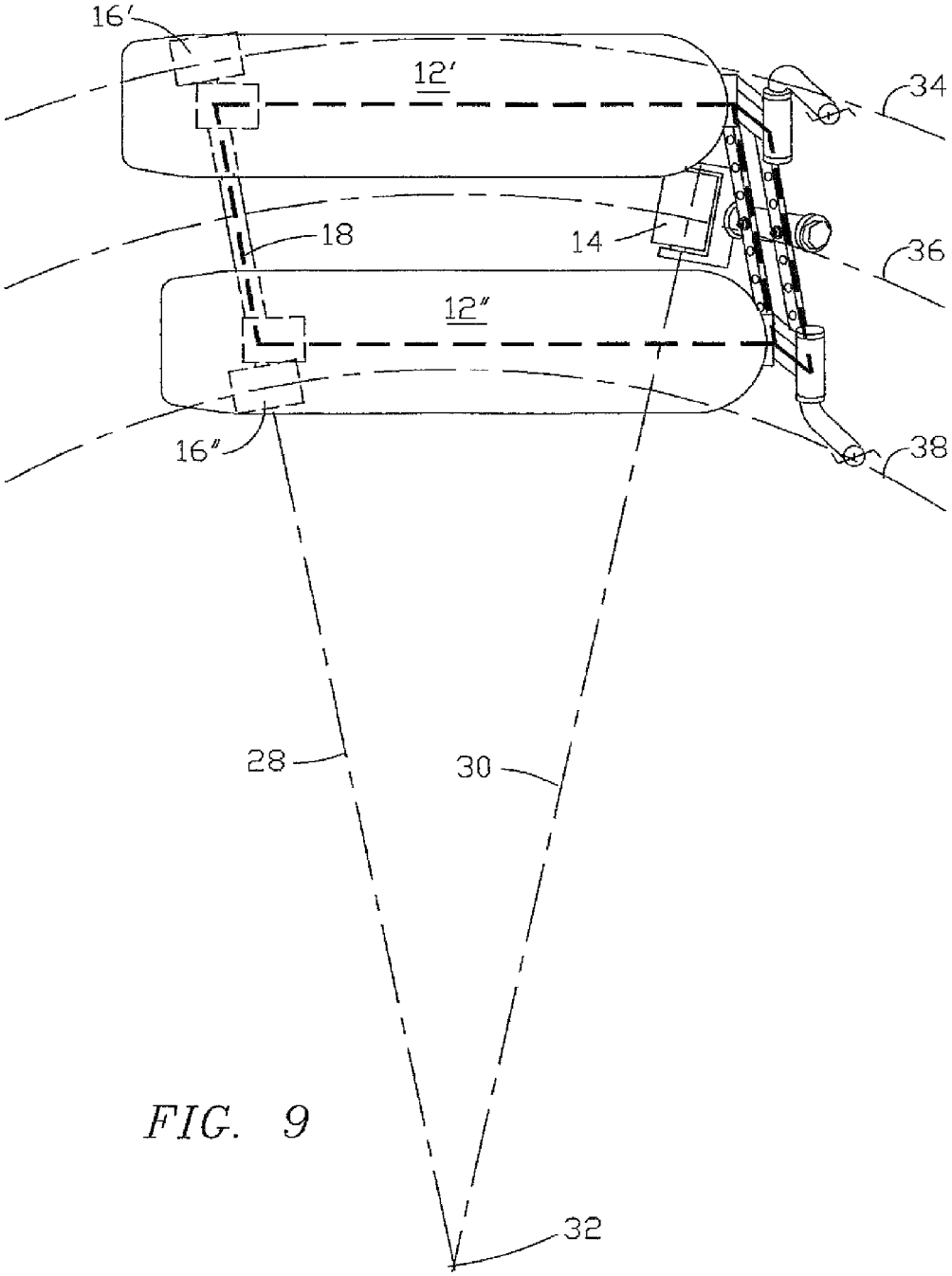
FIG. 9 is a plan view showing the vehicle of FIGS. 1-4 showing the wheels set to turn the vehicle in a curved travel path, indicated by the broken lines, resulting from redirected wheel settings as shown.

FIGS. 7 and 8 are top and front views of the 3-wheeled vehicle, as in FIGS. 5 and 6 but, shown here with the steering system reset to make a right hand turn (as shown in FIG. 9 in response to the user tilting the platforms 12' and 12" each down at their right hand side. The two former rectangles ABCD and ABEF, having become skewed from their "neutral" orthogonal shape, have now become angled parallelograms as shown, with axle assembly 18 rotated to re-aim the rear wheels 16' and 16" as shown and the front caster-type angled-swivel stilt-steer mount 28 (rotated about pivot journal 28, located as shown in the angled plane attached to spacers 20 and 22 along with extension struts 24 and 26), re-aiming the front roller 14 in an azimuth direction opposite that of rear wheels 16' and 16" and the rigid shared rear axle assembly 18 which acts to skew the right hand foot-platform 12" forward, as shown, simulating the advanced technique of "ski-skewing" for a right hand turn.

FIG. 9 is a plan view showing the 3-wheeled vehicle embodiment as in FIGS. 1-8, with the steering system set, by user-tilt of the platforms 12' an 12", to make a sharp right hand turn by re-aiming the rear wheels 16' and 16" and front roller 14 as shown in broken lines, and advancing the right hand foot-platform 12" forward as shown, for "ski-skewing" technique as described above.

Broken-line projection 28 of the axle assembly 18 and rear wheels 16' and 16' and broken-line projection 30 of the axle of the front roller 14, intersecting at point 32, which represents the center point of three circular curved travel paths 34, 36 and 38, shown in broken lines representing the travel paths of the left hand rear wheel 16", the front roller 14 and the right hand rear wheel 16' respectively. The right hand platform 12" is seen to be advanced to a leading position skewed ahead of the left hand platform 12' as shown, thus simulating the advanced technique of "ski-skewing" for turning, wherein the skies are skewed longitudinally (from uniformly side-by-side toe-to-toe for linear travel) such that the "inside" ski, i.e. the one nearer to the direction of the turn, is advanced to lead the "outside" ski by a designated amount proportional to the sharpness of the turn.

Figure 10:
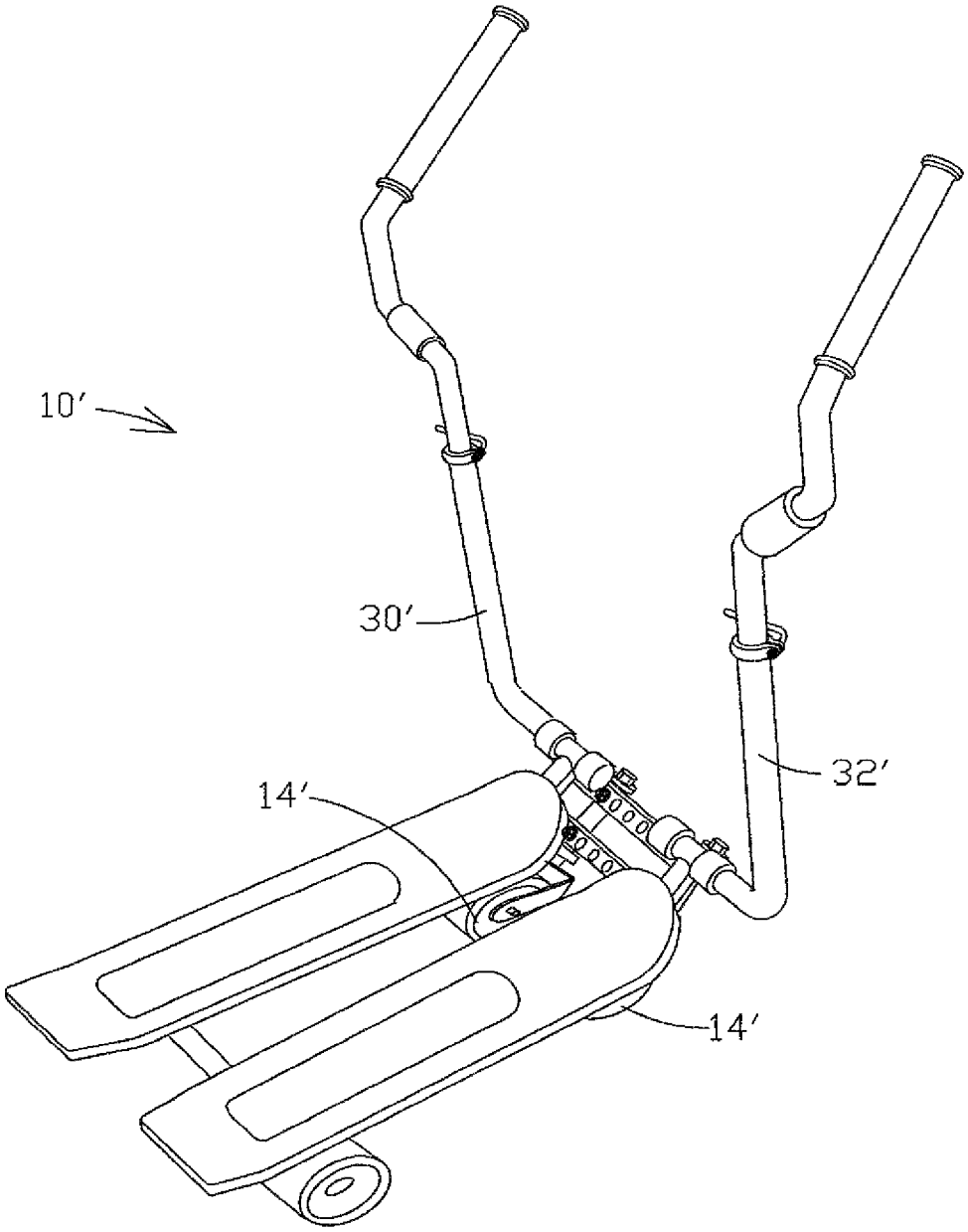
FIG. 10 is a three-dimensional view of a 4-wheeled stand-on land vehicle in a secondary embodiment of the present invention.

FIG. 10 is a three-dimensional view of a 4-wheeled vehicle in a secondary embodiment of the present invention, similar to the 3-wheeled primary embodiment in FIGS. 1-4 except that, at the front, instead of a single central roller 14, a pair of similar rollers 14' are deployed, each in a caster-type angled-swivel stilt-steer mount that functions independently but acts in unison. The two mounts are held spaced apart, typically separated symmetrically near the centers of the platforms, making a larger portion of the platforms stable for standing on than with a single central front roller, with regard to the unsupported outer front regions.

Figure 11:
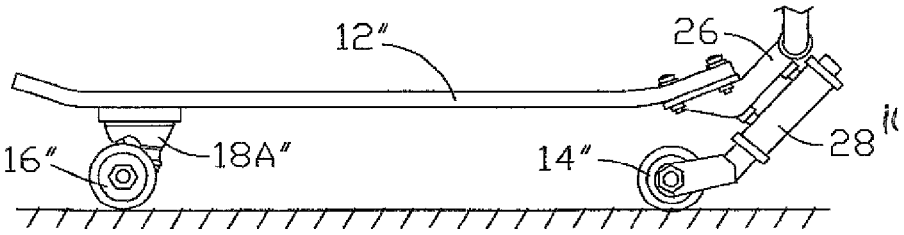
Figure 12:
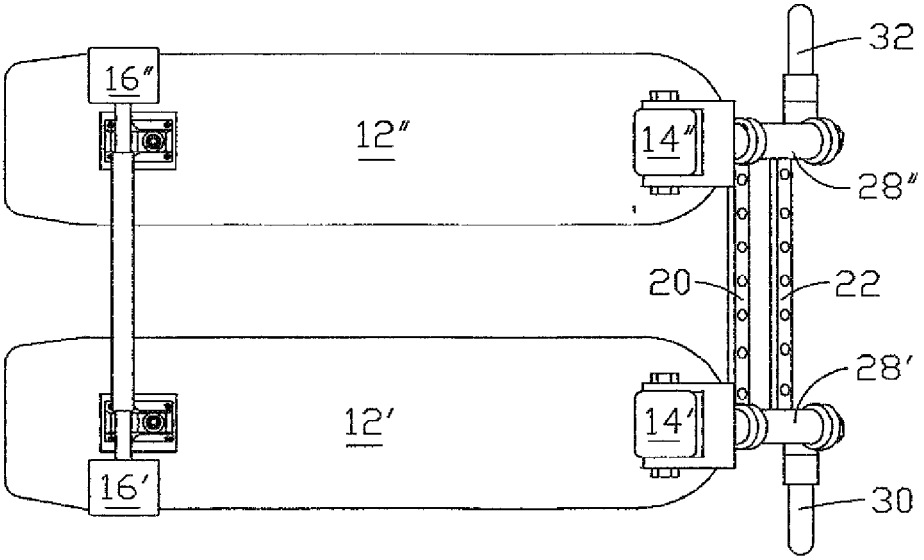
FIG. 12 is a bottom view of the vehicle of FIGS. 11 and 12.

FIGS. 11 and 12 show side and bottom views of the 4-wheeled vehicle of FIG. 10 with the handling bars 30' and 32' cutaway, showing the spaced-apart locations, on cross-member spacers 20 and 21, of the tubular pivot journals 28' and 28" of the front tilt-steer mounts.

FIG. 12, the bottom view, shows locations of the front pair of rollers 14' and 14" and rear pair of wheels 16' and 16".

Figure 13:
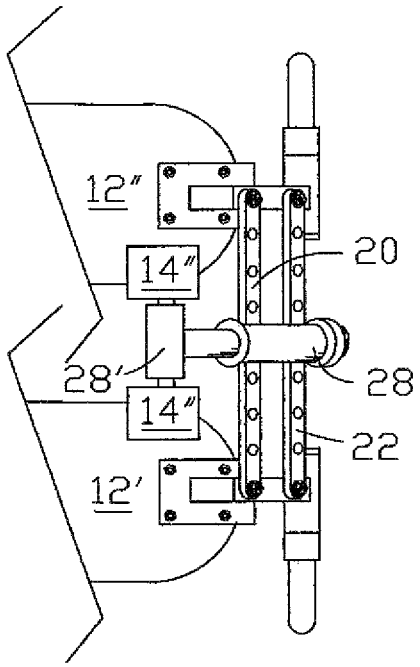
FIG. 13 is an underside view of a front end portion of a vehicle whose front wheel structure utilizes a pair of roller-wheels flanking a single mount journal linked centrally with the steering mechanism, as an alternative to the above-disclosed single roller castor, both enabling three-point vehicle suspension.

FIG. 13 is an underside view of a front end portion of platforms 12' and 12" of a vehicle with front wheel structure implemented by a central dual roller caster wherein a pair of roller-wheels 14", on a common axle, flank a wheel axle journal 28' that is engaged with pivot journal 28 of the steering mechanism, mounted centrally on cross-members 20 and 22 as shown, which need to be coupled resiliently to the steering struts at their end points and made sufficiently strong to support the front end vehicle and rider weight.

Figure 14:
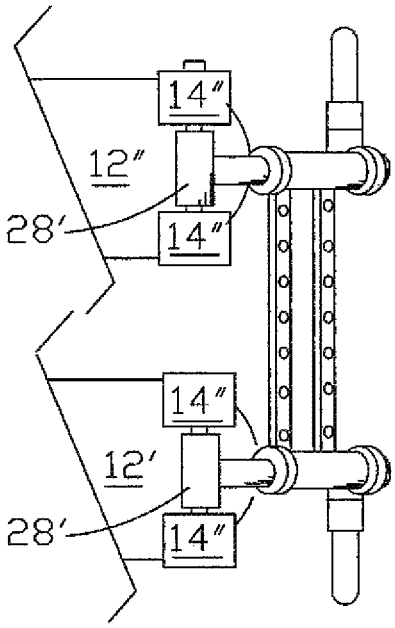
FIG. 14 is an underside view of a front end portion of a vehicle whose front wheel structure utilizes four roller-wheels, i.e. two pairs, each pair flanking a corresponding one of two mount journals linked with steering mechanism, enabling four-point vehicle suspension.

FIG. 14 is an underside view of a front end portion of platforms 12' and 12" of a vehicle with front wheel structure implemented by a pair of dual roller casters each configured as shown in FIG. 13 but each located at front platform centers (instead of vehicle center) thus enable four-point vehicle suspension with rollers 14" extending slightly past the outer edges of the platforms 12' and 12", providing increased stability and safety in a tradeoff for the performance agility capabilities of three-point suspension.

FIG. 15 depicts a known skateboard truck 36 fitted with a pair of roller wheels 14" and attached under a platform indicated by broken lines. Popular skateboards typically utilize a pair of trucks 14" that each include an angle-swivel tilt-steer mount mechanism with a hinge king pin resiliently mounted at one end for limited swivel and shock cushioning, integrated with a pair of oppositely-extending in-line wheel axles. A front truck and a rear truck are attached under the skateboard, oriented in mirror-image relationship for opposite front/rear wheel-pair aiming responsive to lateral tilting of the skateboard platform by the user. The drawing shows a rear view of a front skateboard truck. The particular angle of tilt designated for the king pin is a key design parameter for attaining optimal steering and turning control as applied by the user tilting the platform.

Figure 16:
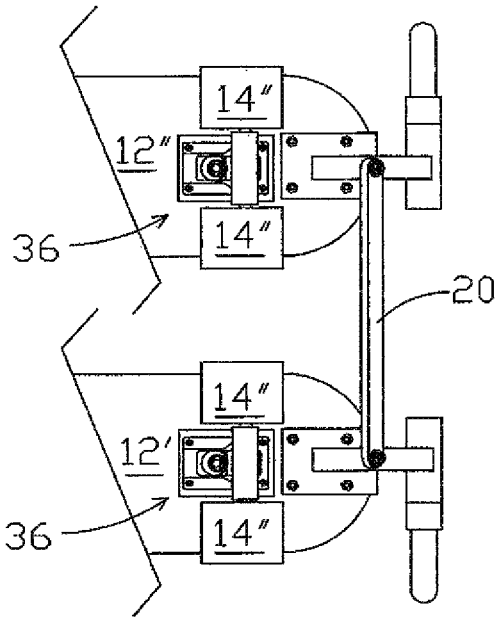
FIG. 16 is an underside view of a front end portion of a vehicle with front wheel structure utilizing two skateboard truck mounts as in FIG. 15, each fastened under a corresponding platform, enabling four-point vehicle suspension.

FIG. 16 is an underside view of a front end portion of a six-wheeled version of the vehicle of the present invention similar to the six-wheeled version of FIG. 14 in performance and stability. The front wheel structure with four roller wheels 14" is implemented by two angled swivel skateboard truck mounts, each configured as in FIG. 15 and fastened under a corresponding platform 12' and 12" as in FIG. 14.

In a third embodiment of the present invention, the nov novelty and advantages of "ski-skewing" capability are provided in a 6-wheeled vehicle with the rear axle assembly and inclined front spacers as disclosed above, utilizing, for front-end support mount, a front truck with dual wheels attached under a front central region of each platform, oriented in mirror-image relation to the rear mounts regarding swivel angle.

Amongst other viable options, a 2-wheeled version utilizes a rear axle assembly configured to support a rear vehicle portion on a single central roller instead of two end-located wheels, and an 8-wheeled version, made equivalent to two dual-truck skateboards connected by spacers that hold them parallel, forming a variable-angle parallelogram framework in the manner of the present invention.

The invention may be practiced with other implementations, variations and alternatives that fall within the spirit and essential characteristics of the invention. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A stand-on land vehicle made capable of simulating snow-skiing for purposes of dry-land practice, training and instruction relating to recreational, competitive and professional snow-skiing, comprising:

a pair of elongate platforms, designated left hand and right hand, held parallel and spaced apart, side-by-side, each providing a substantially flat topside region including an upwardly-facing anti-skid surface for user footing;

a dual-mount axle assembly located under rear regions of said platforms and extending laterally to opposite ends configured as wheel axle portions;

a pair of rear wheels installed on the wheel axle portions; said dual-mount axle assembly including a pair of angled-pivot swivel tilt-steer rear truck-mounts each having an upper end attached centrally underside a rear region of a corresponding one of said platforms and a lower end adjacent to a corresponding one of said wheels, thus supporting a rear portion of said vehicle at two rear support locations at corner angles between said axle and central axes of said platforms, said angled-pivot swivel tilt-steer rear truck-mounts being oriented to be angled such that (a) whenever the user holds said platforms level and thus untilted laterally, a neutral steering condition is maintained for linear travel, the two corner angles being held rectangular and thus holding said platforms parallel and unskewed, and holding said axle assembly and thus said rear wheels aimed at a zero azimuth angle for linear travel; (b) the user initiates a right hand turn by radially tilting said platforms down at the right, forcing the mounts to re-aim said axle assembly and thus said rear wheels to a negative azimuth angle, thus skewing the right hand platform forward, and (c) conversely, the user initiates a left hand turn by radially tilting said platforms down at the left, forcing the mounts to re-aim said axle assembly and thus said rear wheels to a positive azimuth angle, thus skewing the left hand platform forward, thus forming a primary parallelogram;

a primary front spacer, extending horizontally between front center locations of said platforms, is (1) dimensioned in length to match the two rear support locations and thus co-operate therewith to hold said platforms always parallel under all steering conditions, (2) end-fastened to said platforms in a swivel-hinge manner that allows lateral platform tilting by the user, and (b) fastened to at least one front mount with a swivel mechanism angled in mirror image of said rear mounts, made and arranged to aim at least one front wheel to zero azimuth angle for the neutral steering condition, to a positive azimuth angle for a right hand turn and to a negative azimuth angle for a left hand turn;

a front wheel structure comprising at least one front wheel supporting a front portion of said vehicle via at least one angled-pivot tilt-steer swivel front mount oriented to be angled in mirror image of said rear mounts, thus aiming said front wheel structure to a positive azimuth angle for a right hand turn and to a negative azimuth angle for a left hand turn.

2. The stand-on land vehicle as defined in claim 1 further comprising:

a pair of handling bars each fitted with a hand grip and coupled with a corresponding one of said platforms so as to enable the user's hands and feet to co-operate in control of tilt-steering, thus serving to facilitate steering and enhance user balance, training, accomplishment, pleasure and safety.

3. The stand-on land vehicle as defined in claim 2 wherein said pair of handling bars, being nominally oriented vertical and perpendicular to said platforms under neutral steering conditions, are each hingedly coupled with the corresponding foot-platform in a manner that allows said handling bars to be tilted fore-and-aft freely and independently with no resultant effect, whereas lateral tilt thereof is held in unison and directly applied directly to each said platform.

4. The stand-on land vehicle as defined in claim 2 further comprising:

a pair of extension struts, each securely attached to a corresponding one of said platforms and extending forwardly, bent upwardly at a designated angle relative to the substantially flat topside region of the corresponding one of said platforms to form an inclined forward extension portion thereof;

a secondary front spacer, similar to said primary front spacer, end-attached in the swivel-hinge manner to said pair of extension struts at an upper end region of the inclined portion of each, forming a secondary parallelogram, with said primary front spacer as a parallel opposite end, and said extension struts as parallel opposite sides, said front wheel structure further comprising a tilt-steer mechanism configured to operate as an angled swivel caster type mount with a tubular swivel journal attached at each end to said front spacers in a swivel-hinge manner, oriented parallel to the inclined portions of said extension struts, thus inclined at the designated angle from said platforms; and the secondary parallelogram thus being made to be skewable due to corner swivel-hinging, and being held in a plane inclined at the designated angle of incline along with the angled-pivot of the tilt-steer caster type front mount, enabling front steering in conjunction with the primary parallelogram and rear steering as described in claim 1.

5. The stand-on land vehicle as defined in claim 4 wherein said pair of handling bars are coupled with corresponding platforms via attachment to said pair of extension struts, each at an upper end of the inclined portion thereof.

6. The stand-on land vehicle as defined in claim 3 wherein said front wheel structure is configured as a roller with tread-width exceeding its diameter, each roller mounted in an associated swivel caster-type front wheel tilt-steer mount mechanism attached onto said front spacers in accordance with claim 3.

7. The stand-on land vehicle as defined in claim 6 wherein said front wheel structure comprises two front wheels, configured as rollers.

8. The stand-on land vehicle as defined in claim 3 wherein said front wheel structure comprises one and only one front wheel, configured as a roller and located centrally in a front end region of said vehicle.

9. The stand-on land vehicle as defined in claim 1, wherein said front wheel structure comprises two front wheels, each mounted on one of a co-linear pair of wheel axle portions extending from opposite sides of a single centrally-located front axle-truck supporting a front end portion of said vehicle.

10. The stand-on land vehicle as defined in claim 3, wherein said front wheel structure comprises four front wheels, each of two pairs associated with a corresponding one of two front mount mechanisms supporting a front end portion of said vehicle, each wheel of each pair mounted on one of a co-linear pair of wheel axle portions extending from opposite sides of a corresponding one of the two front mount mechanisms.

11. The stand-on land vehicle as defined in claim 1 wherein said front wheel structure comprises two front wheels, and a pair of front mounts, each equipped with a corresponding one of said two front wheels, and each mount located and attached underside a front region of a corresponding platform.

12. The stand-on land vehicle as defined in claim 1 wherein said front wheel structure comprises four front wheels and a pair of front axle-trucks, each fitted with a pair of front wheels one on each side, and each axle-truck located and attached centrally underside a front region of a corresponding platform.

13. The stand-on land vehicle as defined in claim 12 wherein:

said pair of front axle-trucks and said rear truck mounts are each implemented by a commercially available type of skateboard truck that includes a shock-cushioned angled-pivot swivel tilt-steer mount integrated with a pair of co-linear wheel axles extending from opposite sides, typically deployed as an identical pair in a skateboard, front and back, oriented in mirror image relationship for tilt steering;

said pair of front axle-trucks are implemented by unmodified skateboard trucks; and said dual-mount axle-truck assembly extending laterally under rear regions of said platforms is structurally equivalent to two skateboard trucks modified and integrated into said axle-truck assembly by rigidly attaching the ends of an intermediate axle portion in place of one thusly unused wheel axle of each skateboard truck, rendering said axle-truck assembly as a dual-mount axle-truck counterpart of known single-mount skateboard axle-trucks.

* * * * *